US009010381B2

(12) United States Patent
Clüsserath

(10) Patent No.: US 9,010,381 B2
(45) Date of Patent: Apr. 21, 2015

(54) FILLING SYSTEM

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 946 days.

(21) Appl. No.: 13/144,977

(22) PCT Filed: Mar. 17, 2010

(86) PCT No.: PCT/EP2010/001677

§ 371 (c)(1),
(2), (4) Date: Jul. 18, 2011

(87) PCT Pub. No.: WO2010/115504

PCT Pub. Date: Oct. 14, 2010

(65) Prior Publication Data

US 2011/0290374 A1 Dec. 1, 2011

(30) Foreign Application Priority Data

Apr. 6, 2009 (DE) ..... 10 2009 016 322

(51) Int. Cl.

| | |
|---|---|
| ***B65B 3/04*** | (2006.01) |
| ***B67C 3/10*** | (2006.01) |
| ***B67C 3/06*** | (2006.01) |
| ***B67C 3/12*** | (2006.01) |

(52) U.S. Cl.
CPC ... *B67C 3/10* (2013.01); *B67C 3/06* (2013.01); *B67C 3/12* (2013.01)

(58) Field of Classification Search
CPC ..... B67C 3/06; B67C 3/08; B67C 2003/2671
USPC ..... 141/29, 40, 6, 144–152, 290, 301–302, 141/392, 39
See application file for complete search history.

(56) References Cited

U.S. PATENT DOCUMENTS

| | | | | |
|---|---|---|---|---|
| 5,564,481 | A * | 10/1996 | Clusserath | 141/92 |
| 6,131,624 | A * | 10/2000 | Paradies | 141/286 |
| 8,434,529 | B2 * | 5/2013 | Goldbrunner | 141/59 |
| 2011/0197996 | A1 * | 8/2011 | Clusserath | 141/311 R |
| 2011/0272057 | A1 * | 11/2011 | Clusserath | 141/1 |
| 2011/0277881 | A1 * | 11/2011 | Gruber et al. | 141/266 |

FOREIGN PATENT DOCUMENTS

| | | |
|---|---|---|
| DE | 3825093 | 1/1990 |
| DE | 4324592 | 1/1995 |
| DE | 20319619 | 3/2004 |

* cited by examiner

*Primary Examiner* — Timothy L Maust
*Assistant Examiner* — Timothy P Kelly
(74) *Attorney, Agent, or Firm* — Occhiuti & Rohlicek LLP

(57) ABSTRACT

The invention relates to a filling system for filling bottles or similar containers (2) with a liquid filling material, said system comprising at least one filling element, a liquid channel formed in a housing of the filling element and connected to a tank for providing the liquid filling material, and at least one outlet for dispensing the liquid filling material into the respective container attached to the filling element. Said filling system also comprises a liquid valve in the liquid channel, a gas return tube that projects past the at least one outlet on one end, for controlling the level of the filling material in the filled container, and is connected to a gas chamber, formed for example in the tank, by means of a fluid connection. The filling system also comprises an open fluid channel inside the filling element, in the region of the outlet. Said channel can be connected to a ring channel guiding a gaseous and/or vaporous fluid under pressure, preferably an inert gas under pressure, and controlled by at least one first control valve.

16 Claims, 5 Drawing Sheets

FILLING SYSTEM

CROSS-REFERENCE TO RELATED APPLICATIONS

This application is the National Stage of International Application No. PCT/EP2010/001677, filed on Mar. 17, 2010, which claims the priority of German Patent Application No. 10 2009 016 322.0, filed on Apr. 6, 2009. The contents of both applications are hereby incorporated by reference in their entirety.

FIELD OF INVENTION

The invention relates to a filling system for filling containers with a liquid filling material.

BACKGROUND

Filling system for filling containers, such as bottles, with a liquid filling material using a normal pressure filling method are known. In such filling systems, before the start of the actual filling, a container being filled is pressed with its container opening sealed tightly against the filling element. Then, with the container still sealed against the filling element, a liquid valve is opened to begin the actual filling phase. During the filling phase, gas and/or vapor is expelled from the interior of the container as the filling material flows in. This gas is typically air or an inert gas resulting from a previous rinsing, such as $CO_2$ gas. The expelled gas flows, via a return gas pipe that extends into the container, into a gas chamber of a tank that is common to all filling elements of the filling system. The tank is partly filled with the liquid filling material.

The flow of the liquid filling material into the container ends upon immersion of the lower end of the return gas pipe. The height of the return gas pipe thus determines the filling height of filling material in the container. This filling height is determined by an equilibrium between the geodetic filling material head, which is determined by the level of the filling material in the tank, and the filling material or liquid column formed in the return gas pipe and/or fluid channel internal to the filler element at the end of filling phase. The equilibrium point can therefore fluctuate. This can cause small fluctuations in fill level.

A known method of correcting these fluctuations is the Trinox method. In this method, the fluid channel internal to the filling element is pressurized with a pressurized gaseous and/or vaporized fluid. A suitable fluid is an inert gas under pressure, such as $CO_2$ gas. In response, liquid filling material from the fluid channel internal to the filling element is returned out of a head space formed above the lower end of the filling pipe in the container, and out of the return gas pipe into the tank. After executing the Trinox method, the filling level in the container lies slightly below the lower end or lower opening of the return gas pipe. Typically, the fill level lies about 2 mm to 5 mm below the lower opening of the return gas pipe. This filling system is characterized by a simple and reliable construction.

SUMMARY

An object of the invention is to improve the generic filling system by retaining its basic advantages while making possible pressurized or positive pressure filling of containers.

A filling system according to the invention is suitable for, among other things, positive pressure filling, and in particular for pressurized filling. The container being filled is pre-stressed with an inert gas. Before pre-stressing, the container is flushed with the inert gas. Precise setting of the fill level takes place using the Trinox method.

The filling system according to the invention requires merely one additional control valve per filling element, namely in the fluid connection of the return gas pipe with the gas chamber that, on pressure filling, receives the return gas expelled from the interior of the container being filled. This gas chamber is preferably the same gas chamber that is formed above the filling material level in the tank that provides the filling material.

Refinements, advantages and possible applications of the invention will be apparent from the following detailed description, the claims, which are part of the description, and the accompanying drawings, in which:

DETAILED DESCRIPTION

Figure 1:
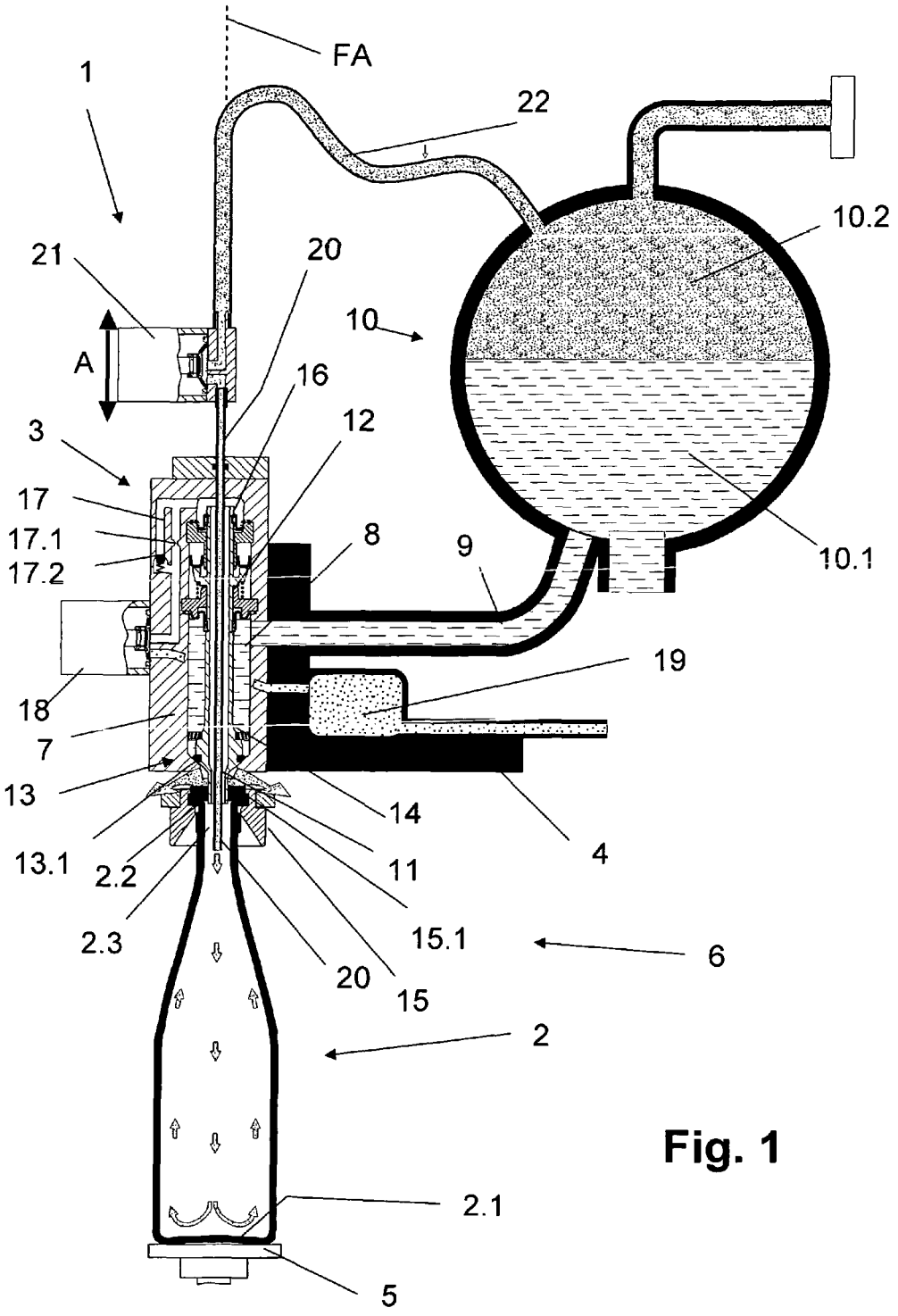
FIGS. 1 to 5 each shows a filling element of a filling system of a machine of current design in simplified view and in cross section, together with a bottle in various phases of the filling process.

The filling system 1 shown in the figures fills containers, such as bottles 2, with a liquid filling material. The filling system 1 comprises a multiplicity of identically designed filling elements 3 on the periphery of a rotor 4 that can be driven to rotate about a vertical machine axis. A container carrier 5 is allocated to each filling element 3. In the embodiment shown, the carrier 5 is a bottle plate on which, during the filling process, a bottle 2 stands on its bottle base 2.1 with its bottle axis oriented in the vertical direction, i.e. along the filling element axis FA. A filling element 3 together with its container carrier 5 constitutes a filling position 6.

Each filling element 3 includes a filling element housing 7. A fluid channel 8 formed in this housing 7 connects, via a product line 9, with a tank 10 common to all filling elements 3 of the filling system 1 or filling machine. The tank 10 is provided on the rotor 4. On the underside of the filling element 3, the tank 10 forms an outlet 11 to discharge the liquid filling material to the bottle 2 at the filling position 6.

During the filling process, the tank 10 is partly filled with liquid filling material to a controlled level. The tank 10 is thus divided into a fluid chamber 10.1 filled by the filling material and a gas chamber 10.2 that lies above the fluid chamber 10.1. During pressure filling, the pressure of an inert gas, for example $CO_2$ gas, controls the pressure within the gas chamber 10.2.

A control device 12 controls a liquid valve 13 in the fluid channel 8. The liquid valve 13 comprises a valve body 13.1 formed by a tube 14. The tube 14, which is open at both ends and which is coaxial with a vertical filling element axis FA, protrudes through the outlet 11 over the underside of the filling element 3 or a ring seal 15.1 provided in a centering sleeve 15. An upper end of the tube 14 opens into a chamber 16 that is part of a system of gas ways 17 formed in the filling element housing 7. Through the gas ways 17, the chamber 16, and hence also a fluid channel formed inside the tube 14 internal to the filling element, can also be connected to a ring channel 19 by controlling a first control valve 18. Details of making the connection are described below.

The ring channel 19 is common to all filling elements 3 on the rotor 4. During the filling process, the ring channel 19 carries an inert gas at a pressure that is greater than the pressure in the gas chamber 10.2. A suitable inert gas is $CO_2$ gas under pressure.

Each filling element 3 comprises a return gas pipe 20 for determining a filling height. The return gas pipe 20 is coaxial with the filling element FA. From above, the return gas pipe 20 passes, sealed by the filling element housing 7, through the chamber 16 and continues through the tube 14. Its lower end, or the opening therein, protrudes from the lower end of the tube 14. The upper end of the return gas pipe 20 connects, via a second control valve 21 and a flexible line 22, to the gas chamber 10.2 of within tank 10.

When the Trinox method is used, the return gas pipe 20 determines the fill level in the bottle at the end of the filling process. To adjust the fill height, the return gas pipe 20 of each filling element 3 can be adjusted to move up and down along the filling element axis FA, as indicated by double arrow A. A central adjustment device can control this adjustment.

A special feature of the filling system 1 is the second control valve 21, which is disposed in the connection between the return gas pipe 20 and the gas chamber 10.2. With the filling system, with the filling elements 3, and/or with the corresponding filling machine, the presence of this second control valve 21 makes various filling methods possible. For example, pressure or positive pressure filling becomes possible, as described in connection with FIGS. 1 to 5. In the description of the illustrated method, the liquid valve 13 and the first and second control valves 18, 21 are each in their closed position as long as the open position is not expressly specified.

The first step is to flush the bottle 2 with inert gas, as shown in FIG. 1. After delivering the bottle 2 to a filling position 6, the bottle is raised towards the filling element 3, but not all the way to the filling element 3. This leaves a gap between the bottle opening 2.2 and the seal 15.1. Opening the second control valve 21 introduces inert gas from the gas chamber 10.2 via the return gas pipe 20 to flush the bottle 2. This causes air in the bottle 2 to dissipate via the gap between the bottle opening 2.2 and the seal 15.1. As the air dissipates, progressively greater amounts of the inert gas also dissipate through this gap.

In another embodiment, dissipation of air and inert gas during flushing can also take place via a gas channel formed in the filling element housing 7. In this embodiment, the bottle 2 lies pressed with its bottle opening 2.2 sealed against the filling element 3 or against the seal 15.1 even during the abovementioned flushing operation.

Figure 2:
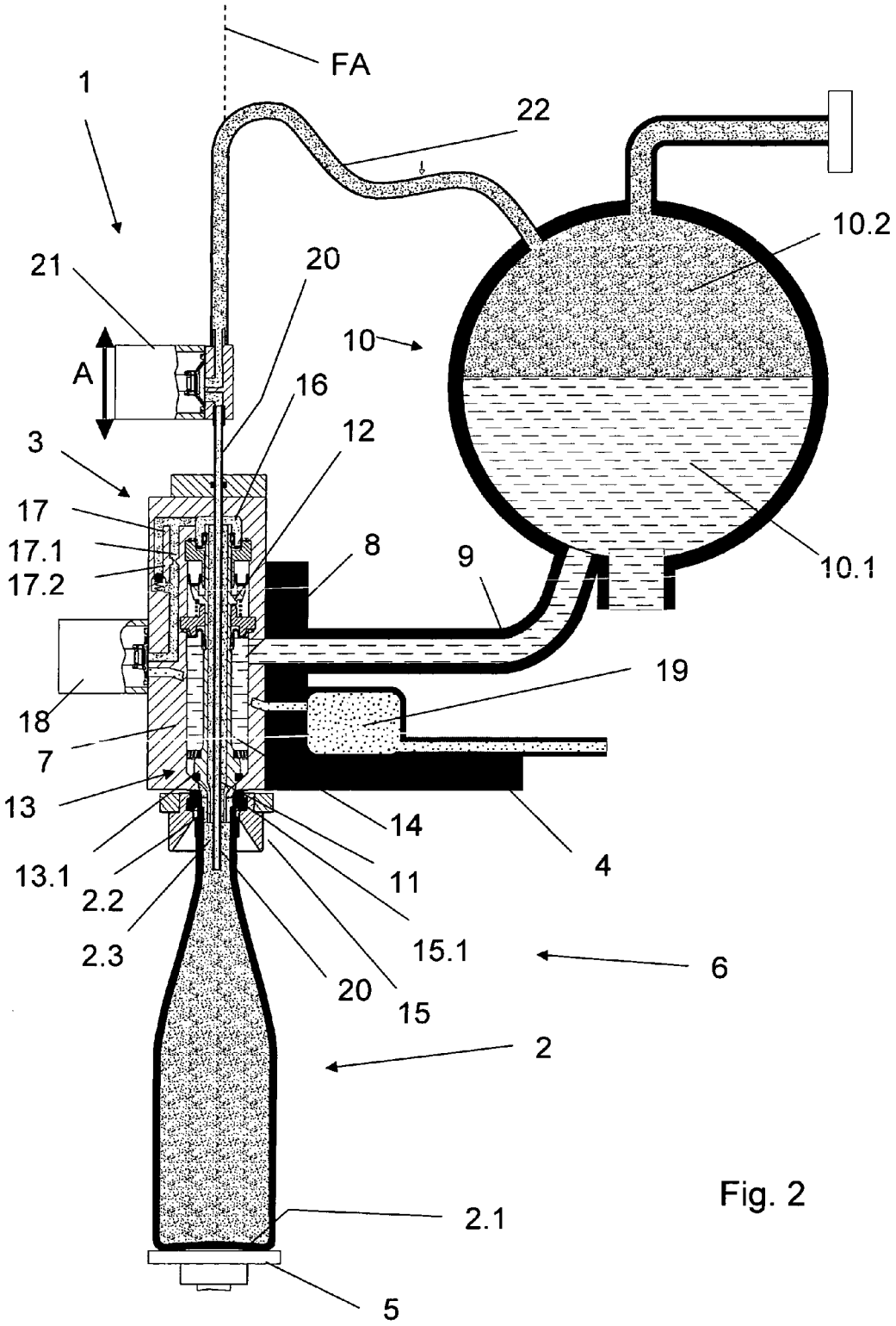

FIG. 2 shows the next step, namely pre-stressing the bottle 2. With the bottle 2 sealed against the filling element 3, opening the second control valve 21 exposes the interior of the bottle 2 to a pressurized inert gas from the gas chamber 10.2. This pre-stresses the bottle 2.

Figure 3:
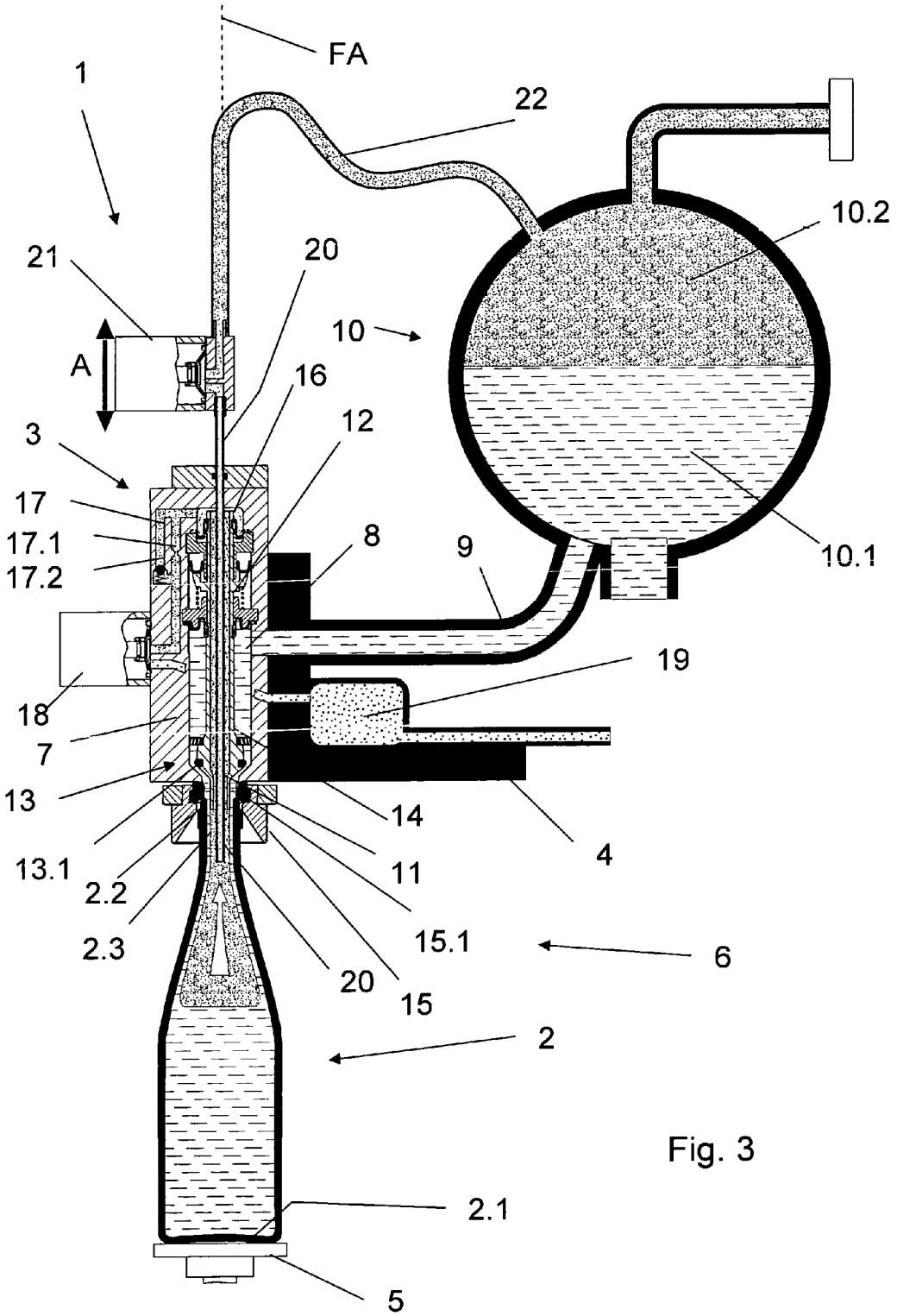

FIG. 3 shows the next step, namely filling the bottle 2. With the bottle 2 still sealed against the filling element 3, and with the second control valve 21 open, the liquid valve 13 is opened. This allows liquid filling material to flow into the bottle 2 via the outlet 11. The inert gas expelled by the liquid filling material from the interior of the bottle, at least in the end phase of filling, is expelled solely via the return gas pipe 20 and the opened second control valve 21 into the gas chamber 10.2.

The flow of the liquid filling material into the bottle 2 automatically ends while the liquid valve 13 is still open. In particular, the flow ends upon immersion of the opening at the lower end of the return gas pipe 20 into the filling material in the bottle 2. This filling material will have risen both in the return gas pipe 20 and in the tube 14 to a height such that equilibrium exists between the filling material column in the return gas pipe 20 or in the tube 14 and the geodetic head of the filling material in the tank 10.

Figure 4:
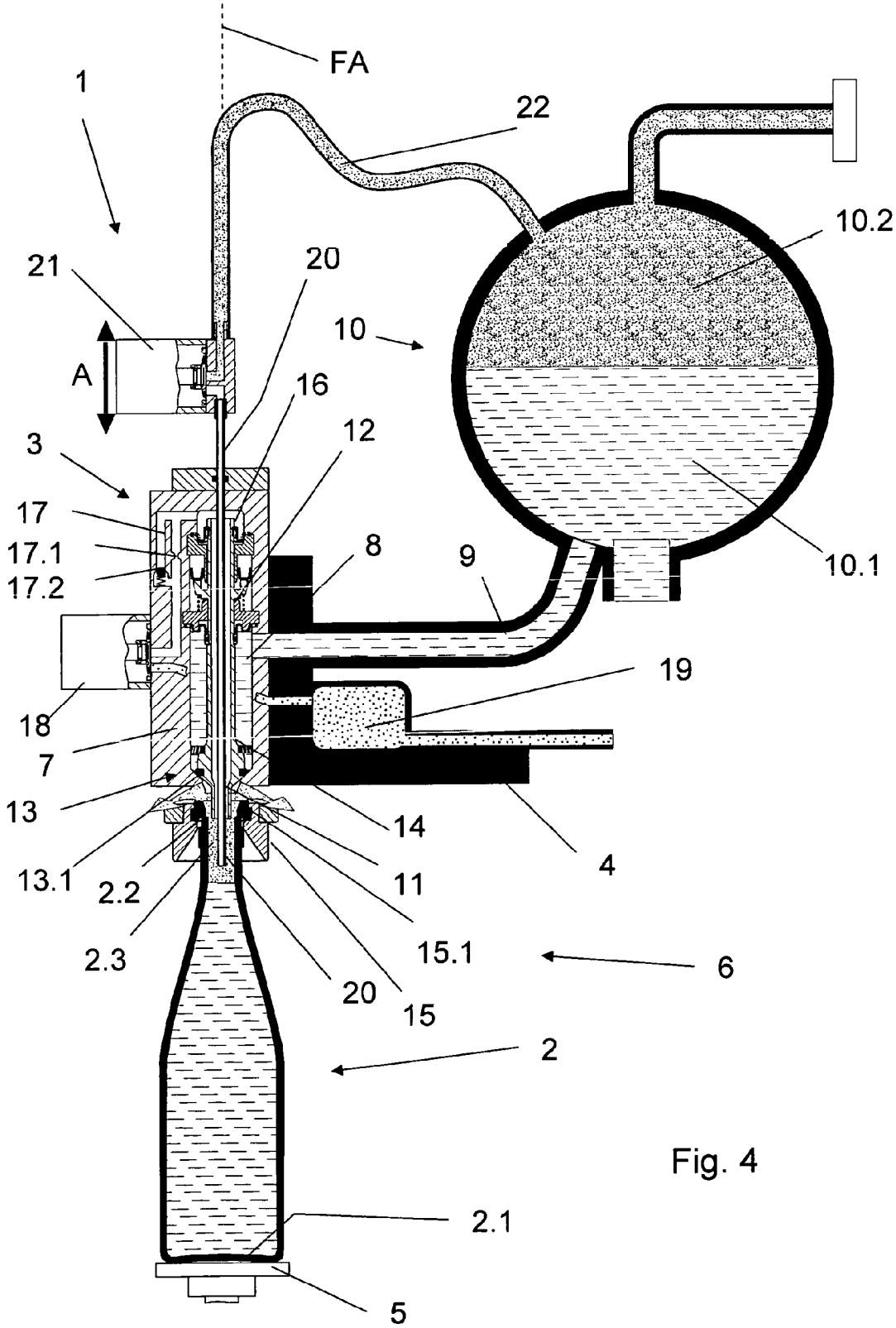

The next steps, which are shown in FIG. 4, are to adjust the precise filling height, and to return the filling material to the tank 10. The filling material to be returned comes from the tube 14, the return gas pipe 20, and the headspace 2.3 of the bottle 2 above the lower end of the return gas pipe 20.

With the liquid valve 13 closed and the second control valve 21 open, the first control valve 18 is opened. As a result, pressurized inert gas from the Trinox or ring channel 19 enters. This forces the filling material to be returned into the tank 10 until the level of the liquid filling material within the bottle is approximately 2 to 5 mm below the lower end of the return gas pipe 20. The chamber 16, the tube 14, and the fluid channel provided internal to the filling element are all connected to the ring channel 19 via the open first control valve 18 and a choke 17.1 provided in the gas ways 17.

Figure 5:
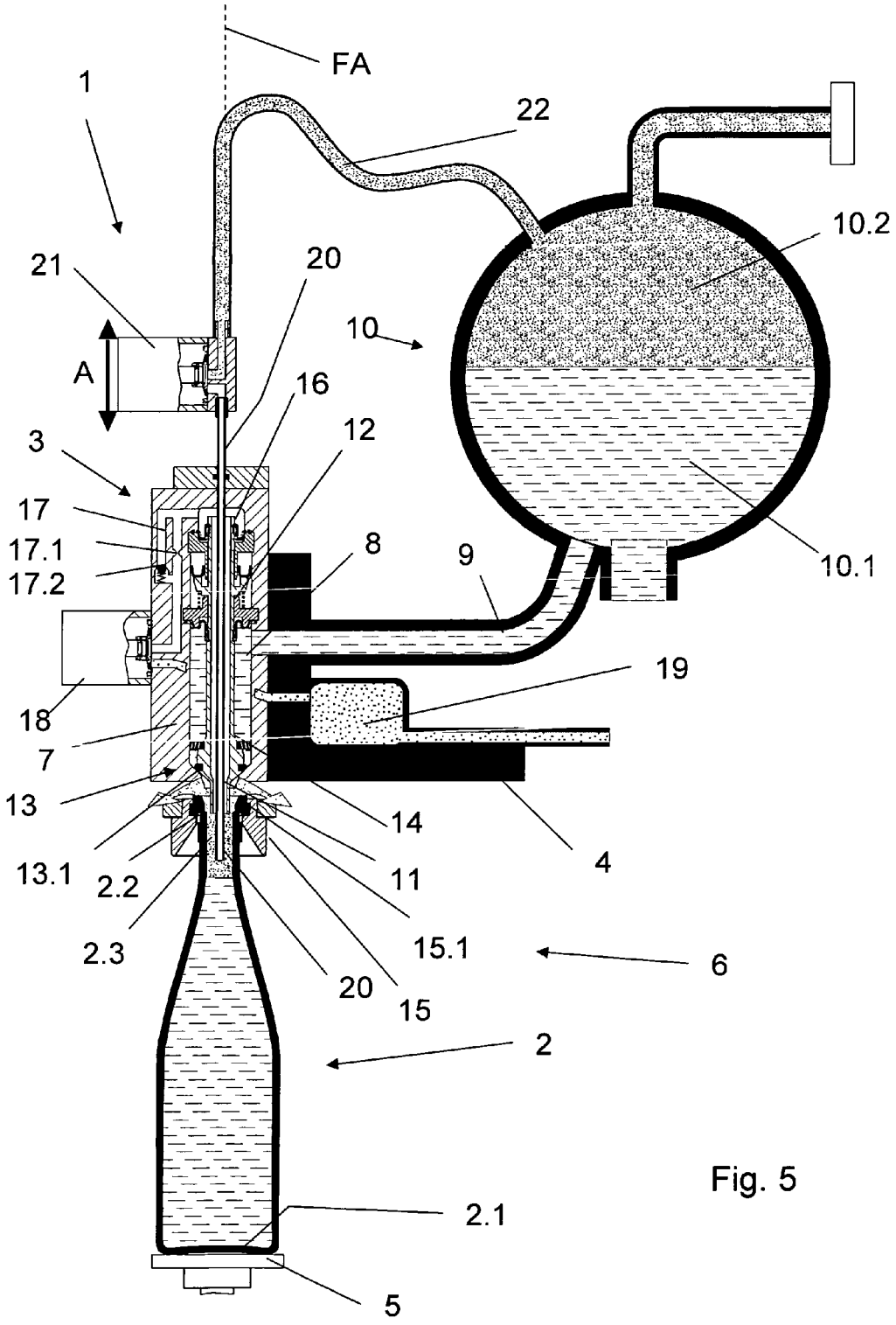

After the precise adjustment of the filling level and drainage of the return gas pipe 20, the bottle is lowered and relieved, as shown in FIG. 5. This requires closing the first and second control valves 18, 21, closing the liquid valve 13, and controlled lowering of the container carrier 5.

With the filling system 1 as described herein, it is possible to carry out positive pressure filling of the bottle 2 described above. However, it is also possible to carry out normal pressure filling, and, in particular, normal pressure filling with adjustment of the precise fill level using the Trinox method.

To carry out normal pressure filling, the gas chamber 10.2 of the partly filled tank 10 is filled with inert gas at atmospheric pressure. The filling of the bottle 2 then takes place with the second control valve 21 permanently open. The bottle 2 is first pressed against the filling element 3 with a seal. To initiate the filling phase, the liquid valve 13 is opened. After closing the liquid valve 13, the first control valve 18 is opened again to adjust the precise fill level with the Trinox method.

Due to the second control valve 21, the filling system 1 is suitable for carrying out positive pressure filling as described above, and doing so without great complexity. The filling system thus offers the advantage of permitting both normal pressure filling and positive pressure filling.

Despite the possibility of adjusting the fill level for all filling elements together, for example automatically, and despite the integral Trinox filling level correction or adjustment for precise filling levels, the filling system requires only two control valves 18, 21 per filling element 3. These valves 18, 21 can be controlled pneumatically.

In addition to the tank 10, in the simplest case only one further gas channel is required for all filling elements 3, namely the ring channel 19 on the rotor. The ring channel 19 can also be used for CIP cleaning of the filling machine. To carry out CIP cleaning, a non-return valve 17.2 is provided in the gas way 17 parallel to choke 17.1.

The present invention also extends to a method in which the container or the bottle is withdrawn from the filling element without the prior relief phase i.e. under positive pressure.

Withdrawal under positive pressure is possible because the Trinox method leaves a gap between the filling material level and the lower end of the return gas pipe 20 and because the second control valve 21 can be used to interrupt the connection to the gas chamber 10.2 via the flexible line 22. The small distance between the lower end of the return gas pipe 20 and the filling material level constitutes an open gas connection between the headspace of the bottle 2 and the return gas pipe 20.

Before lowering the bottle 2, the second control valve 21 is closed. This prevents further flow of pressurized gas from the tank 10. Upon withdrawal of the bottle 2 from the filling valve seal, the gas volume existing inside the return gas pipe 20 automatically expands. This results in formation of a gas or pressure pulse that is directed towards the end of the return gas pipe 20.

Because the lower end of the return gas pipe 20 is spaced above the filling material level, the gas or pressure pulse that emerges from the return gas pipe 20 and that is directed onto the filling material only has a restricted minimal effect. This is because substantial expansion or diffusion losses are associated with its emergence from the return gas pipe 20.

Finally the procedure described above allows a clear reduction in undesirable foaming of the filling material. At the same time, the otherwise normal pressure release valve relied upon in the prior art can be omitted.

Having described the invention, and a preferred embodiment thereof, what is claimed as new, and secured by Letters Patent is:

1. An apparatus for filling containers with a liquid filling material, said apparatus comprising a filling system, wherein said filling system comprises a filling element, wherein said filling element comprises a housing, a first fluid channel, a second fluid channel, an outlet, a liquid valve, a first control valve, a second control valve, a return gas pipe, a tank, and a gas chamber, wherein said first fluid channel is formed in said housing, wherein said first fluid channel is connected to said tank for providing said liquid filling material, wherein said outlet discharges said liquid filling material into a container that is provided at said filling element, wherein said liquid valve is in said first fluid channel, wherein said second fluid channel is internal to said filling element, wherein said second fluid channel is open in an area of said outlet, wherein said first control valve is configured to selectively connect a ring channel to said second fluid channel, wherein said ring channel carries a pressurized gas, wherein said return gas pipe controls an extent to which said liquid filling material fills said container, wherein said return gas pipe comprises a first end that protrudes over said outlet, wherein said return gas pipe connects to said gas chamber via a fluid connection, wherein said second control valve provides controlled opening and closing of said fluid connection between said return gas pipe and said gas chamber, wherein said second control valve is configured to be opened prior to initiation of a filling phase to flush and pre-stress an interior of said container using a pressurized inert gas that is delivered from said gas chamber via said return gas pipe, wherein said liquid valve is configured to be opened to allow liquid into a flushed and pre-stressed interior of said container, wherein said first control valve is configured to be opened for adjustment of an extent to which a container lying sealed with the filling element is to be filled, and wherein the second control valve is configured to be opened to expel liquid filling material from at least out of a head space formed in the container above an end of the return gas pipe that extends into the container, thereby determining the fill height of the container, whereby said filling system achieves positive pressure filling of said container, and whereby only said first control valve, said liquid valve, and said second control valve are needed to control said filling system.

2. The apparatus of claim 1, wherein the second control valve is a pneumatically activated valve.

3. The apparatus of claim 1, wherein the second fluid channel is formed at least in part on a part length of a ring channel surrounding the return gas pipe in a tube.

4. The apparatus of claim 1, wherein the filling element in the area of the outlet comprises a contact surface surrounding the outlet, said contact surface sealing a mouth of said container during at least one phase of a filling process.

5. The apparatus of claim 1, wherein the return gas pipe includes a second end that protrudes through the outlet and the contact surface out of the filling element or filling element housing.

6. The apparatus of claim 1, wherein the second fluid channel comprises a pipe that protrudes with an open end through the outlet out of the filling element or filling element housing.

7. The apparatus of claim 1, wherein the return gas pipe is axially mobile to adjust the filling height of the container.

8. The apparatus of claim 1, further comprising a rotor that can be driven to rotate about a vertical machine axis, wherein said filling element, along with a multiplicity of additional filling elements that are identical to said filling element, are mounted on said rotor.

9. The apparatus of claim 1, wherein said gas chamber is formed in said tank.

10. The apparatus of claim 3, wherein the tube and the return gas pipe are coaxial.

11. The apparatus of claim 4, wherein said contact surface comprises a seal against which the container mouth lies during the at least one phase of the filling process.

12. The apparatus of claim 1, wherein the filling element is one of a plurality of identical filling elements, wherein the apparatus further comprises a corresponding plurality of return gas pipes, wherein each of said return gas pipes is axially mobile, and wherein each of the return gas pipes is axially movable by an adjustment device.

13. The apparatus of claim 1, wherein said second control valve is configured to be opened prior to initiation of a filling phase to flush and pre-stress the interior of a container lying sealed against the filling element.

14. The apparatus of claim 1, wherein said second control valve is configured to be opened prior to initiation of a filling phase to flush and pre-stress the interior of a container separated from said filling element by a gap.

15. The apparatus of claim 1, wherein said first control valve is a pneumatically activated valve.

16. A method for operating the apparatus of claim 1, said method comprising:

closing the second control valve after the end of a filling phase;

adjusting the filling height by pressurizing the second fluid channel with an inert gas thereby returning the liquid filling material in the second fluid channel out of the head space and the return gas tube and into the tank; and withdrawing the container under positive pressure from the filling element, wherein withdrawing said container under positive pressure occurs without a prior relief phase.

* * * * *